US005426904A

United States Patent [19]

Gilmore

[11] Patent Number: 5,426,904

[45] Date of Patent: Jun. 27, 1995

[54] PARTITION WALL FRAMING ASSEMBLY FOR SUSPENDING GYPSUM BOARD PANELS

[76] Inventor: Thomas M. Gilmore, 121-53279 Range Rd. 225, Sherwood Park, Alberta, Canada, T8A 4V1

[21] Appl. No.: 193,951

[22] Filed: Feb. 9, 1994

[51] Int. Cl.[6] ..... E04B 5/52

[52] U.S. Cl. ..... 52/489.1; 52/481.1; 52/511; 52/241

[58] Field of Search ..... 52/489.1, 489.2, 483.1, 52/511, 481.1, 481.2, 721, 238.1, 241; 403/245, 246; 211/191, 192, 193

[56] References Cited

U.S. PATENT DOCUMENTS

| | | | |
|---|---|---|---|
| 3,753,325 | 8/1973 | Stanley et al. | 52/489 |
| 3,948,011 | 4/1976 | Price et al. | 52/241 |
| 4,064,996 | 12/1977 | Shillum | 211/191 |
| 4,157,228 | 6/1979 | Hammerschlag | 211/192 X |
| 4,428,172 | 1/1984 | Larsson | 52/489 |
| 4,448,004 | 5/1984 | Thorsell | 52/241 |
| 4,567,698 | 2/1986 | Morrison | 52/36 |
| 4,598,521 | 7/1986 | Slapsys et al. | 52/484 |
| 4,693,047 | 9/1987 | Menchetti | 52/664 |
| 4,704,835 | 11/1987 | Jordan | 52/489.1 |
| 4,811,539 | 3/1989 | Menchetti | 52/486 |
| 5,060,434 | 10/1991 | Allison | 52/238.1 |
| 5,216,859 | 6/1993 | Moreno et al. | 52/238.1 |

FOREIGN PATENT DOCUMENTS 1037172 7/1966 United Kingdom .

*Primary Examiner*—Carl D. Friedman
*Assistant Examiner*—Kien Nguyen
*Attorney, Agent, or Firm*—Sheridan Ross & McIntosh

[57] ABSTRACT

A structural frame is provided comprising opposed ceiling and floor channels and spaced apart, C-shaped metal studs extending vertically between the channels. Each stud has its single central web positioned transversely relative to the main plane of the frame. Pairs of short brackets are suspended from the webs of adjacent studs in opposed and vertically spaced relation. Each bracket comprises a horizontal V-shaped wall having downwardly extending side walls which form vertical end edges at the end of the bracket adjacent the web. A plurality of hooks extend from these end edges. A pattern of vertical slots is formed in the stud web and the bracket hooks extend into these slots and attach to the web. The bracket is sized to fit snugly between the side walls of the C-shaped stud, to reinforce these walls so that they do not collapse inwardly when loaded. A gypsum board panel having suspension assemblies attached to its back surface is suspended from the brackets as the suspension assembly clips engage the sloping segments of the bracket's V-shaped wall. The bracket end edges bear against the web and distribute the panel load thereover, so that the stud is not deformed. Each bracket is "single sided"—that is, it extends perpendicularly from only one side of the web. Thus a stud and bracket can be used to start a wall from an abutting position with another wall.

11 Claims, 5 Drawing Sheets

PARTITION WALL FRAMING ASSEMBLY FOR SUSPENDING GYPSUM BOARD PANELS

FIELD OF THE INVENTION

The present invention relates to an improved framing assembly upon which gypsum board panels are suspended to form a removable partition wall.

BACKGROUND OF THE INVENTION

Demountable or removable partition walls are widely used in office buildings and the like. The main characteristic of these systems is that a "knock-down" framing assembly is erected and removable gypsum board facing panels are suspended from the framing assembly. Three prior art embodiments are shown in FIGS. 1–3. Having reference to the Figures, these embodiments have the following features in common:

- the facing panels are equipped with horizontal linear arrays o of suspension assemblies h mounted to the panel on its rear face;
- each suspension assembly h comprises a gang nail plate p, having tangs (not shown) embedded in the panel material, and a clip t secured to the plate p and having a downwardly, rearwardly, angled portion u;
- opposed channels b, a are mounted to the ceiling and floor;
- laterally spaced metal studs c extend between the ceiling and floor channels b, a;
- the stud c may be C-shaped (with a single web v) or U-shaped (with a double web s);
- each web v, s has cut-outs n at spaced positions along the vertical extent of the stud;
- horizontal support channels f extend through the cut-outs n and are supported by the studs c;
- the floor and ceiling channels and studs form a 'frame' and the frame combines with the support channels to form a 'framing assembly'; and
- each support channel f has inwardly sloping and converging walls d for engaging and supporting the angled portions u of the clips t, so that the panels g are suspended by the clips t from the sloping walls d and are "cammed" or drawn in tightly against the framing assembly.

U.S. Pat. Nos. 3,948,011 (Price et al), 4,693,047 (Menchetti) and 4,448,004 (Thomell) are exemplary of the pertinent prior art.

In both Menchetti's and Thorsell's systems, the horizontal support channel extends continuously through adjacent studs for support. This is shown in Prior Art FIG. 2 for the Thorsell system. The suspension assembly clips engage the support channel near the studs—thus there is a portion of the continuous support channel that serves little purpose. In addition, the continuous support channel interferes with installation of wiring and the like in the wall cavity between facing panels.

In U.S. Pat. No. 4,811,539 (Menchetti) a short discontinuous support channel is disclosed (see Prior Art FIG. 3). But this short support channel requires the use of a double-webbed, U-shaped stud for support. In addition, the stud must be formed of heavy gauge (30/1000" thickness) steel, to avoid deformation at the cut-outs. These studs are difficult to manually trim on site with shears. As a result, in commercial practice the stud is supplied in conjunction with a telescoping base or "stud shoe" m. In addition, the U-shaped stud has one side facing out which has an open vertical slot—thus one cannot fasten with screws to this stud face (which is desirable on occasion). In practice, this leads to having to stock both U-shaped and C-shaped studs for use in the wall.

In the prior art systems, the support channels extend through and protrude from the stud. This structure cannot be used to begin a wall. Thus, in this circumstance, screws are used to secure a pair of panels to a C-shaped starting stud. The screws must then be hidden by an applied batten.

With this background in mind, it is the objective of this invention to devise short, discontinuous, "one-sided" support channels which can be used with light gauge, single webbed, C-shaped studs to provide an improved and less expensive framing assembly.

SUMMARY OF THE INVENTION

The present invention is therefore concerned with a demountable partition wall having a novel framing assembly for supporting suspended gypsum board facing panels.

The framing assembly comprises:

- floor and ceiling channels;
- laterally spaced, vertical, preferably C-shaped, metal studs extending between the floor and ceiling channels;
- each stud having its web positioned transverse to the main plane of the assembly, said web forming one or more patterns of vertical slots at spaced points along its length; and
- one or more short, "one-sided" brackets or support channels suspended from the web, each bracket being adapted to project from only one face of the web;
- each bracket having a horizontal channel wall, preferably forming inwardly sloping, converging support surfaces for engaging and supporting the clip of a suspension assembly;
- the bracket further having a pair of side walls extending downwardly from the side edges of the channel wall, said side walls forming vertical end edges for abutting the stud web and distributing the panel load to the web;
- the side walls having slotted hooks extending from the end edges for penetrating the slots and engaging the web to suspend the bracket therefrom;
- each hook slot preferably having an angled surface for causing the bracket to be drawn in tightly against the web;
- the slot pattern preferably taking the form of two vertical rows, typically with three slots per row, and the bracket having one hook extending from an intermediate point on one end edge and two hooks extending from the ends of the other end edge, so that a pair of brackets can be suspended at the same elevation on the two sides of the web using a single pattern of slots;
- the bracket preferably having a width selected so that it fits snugly between the two side walls of the C-shaped stud, so that the bracket reinforces the stud and resists inward collapse of the walls when the stud is loaded;
- the side walls preferably having means protruding from their second ends for spacing the panel from the bracket so that they are substantially parallel.

From the foregoing, it will be noted that applicant has provided a framing assembly having "one-sided"

brackets adapted to extend from only one side of the web, thereby enabling the bracket to be used with a starting stud to initiate a wall.

Furthermore, the load is now distributed by the end edges over a relatively large area of the web. This has made it possible to use light gauge (22/1000" thickness) steel in fabricating the stud, without the occurrence of stud deformation when loaded. Since the wall thickness of the steel is less, it is now possible to manually cut the studs on site and closely fit the stud between channels without use of a telescoping boot.

BRIEF DESCRIPTION OF THE DRAWINGS

FIGS. 1, 2 and 3 present prior art framing assemblies and removable facing panels in which:

FIG. 1 is a side elevation of a partition wall with some of the facing panels removed to expose the framing assembly;

FIG. 2 is a partly broken away perspective view of a framing assembly using continuous horizontal supports;

FIG. 3 is a partly broken away perspective view of a framing assembly using short discontinuous horizontal supports;

FIGS. 4–10 illustrate the improved framing assembly of the present invention in which:

FIG. 4 is a side view of the partition wall system which is starting from an abutting wall. Some of the panels are removed to expose the framing assembly;

FIG. 5 is an exploded perspective view of a pair of brackets mounted to both sides of a stud web. A portion of a facing panel and a suspension assembly are shown engaging one bracket;

FIG. 6 is a side view of an assembled bracket and stud. The stud's flange is partially cutaway to expose the slotted hooks engaging one pattern of vertical slots;

FIG. 7 is an end view of the bracket and stud of FIG. 6 viewed along line 7–7;

FIG. 8 is a side view of a pair of brackets suspended from the same pattern of vertical slots formed in a stud. The stud's flange is partially cutaway to expose the slotted hooks engaging the pattern of vertical slots;

FIG. 9 is a top view of the two brackets and stud of FIG. 8 viewed along line 9—9. The suspension assemblies are shown engaging the brackets' support surfaces; and FIG. 10 is an exploded perspective view of a pair of brackets to show an alternate pattern of vertical slots and hooks, and an alternate form of panel spacing means.

DETAILED DESCRIPTION OF THE PREFERRED EMBODIMENT

Figure 1:
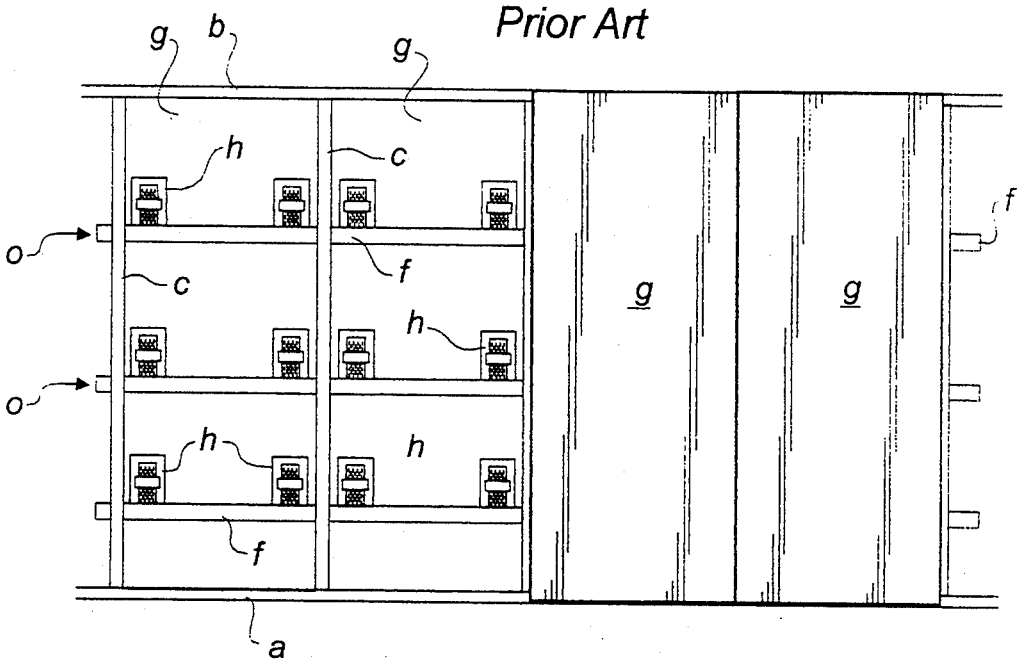
Fig. 1. Prior Art
Figure 2:
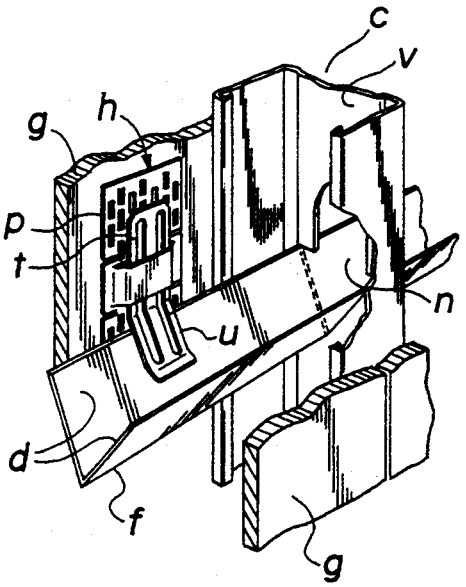
Fig. 2. Prior Art
Figure 3:
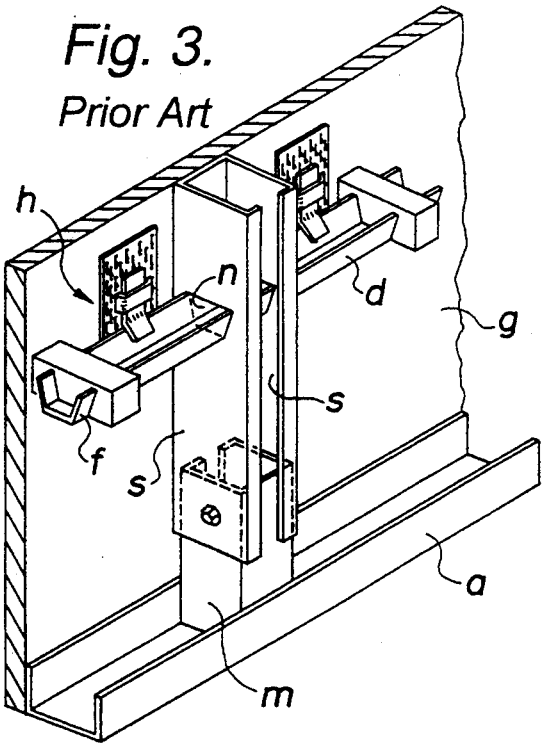
Fig. 3. Prior Art
Figure 4:
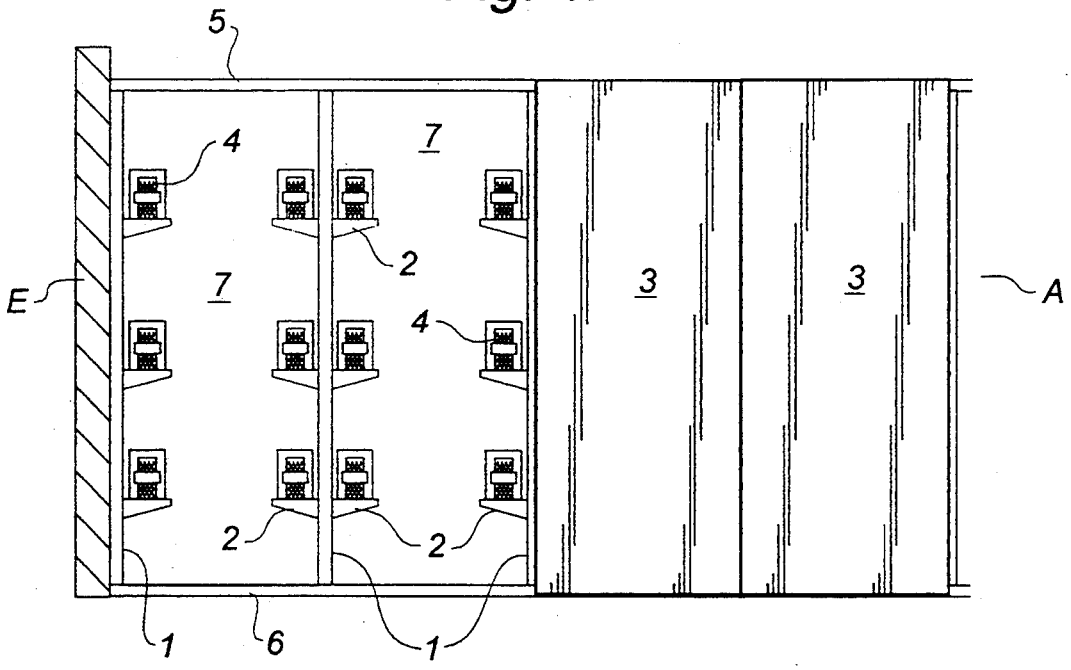

Having reference to FIG. 4, a portion of the framing assembly of a removable partition wall is shown to include laterally spaced, vertical stud members 1 supporting a plurality of horizontal support brackets 2. The studs 1 are fitted into the ceiling and floor channels 5, 6. Gypsum board facing panels 3 are suspended from the brackets 2 by means of a plurality of suspension assemblies 4 affixed to the rear face of each panel 3. A wall cavity 7 is formed between facing panels 3 and adjacent studs 1.

Figure 5:
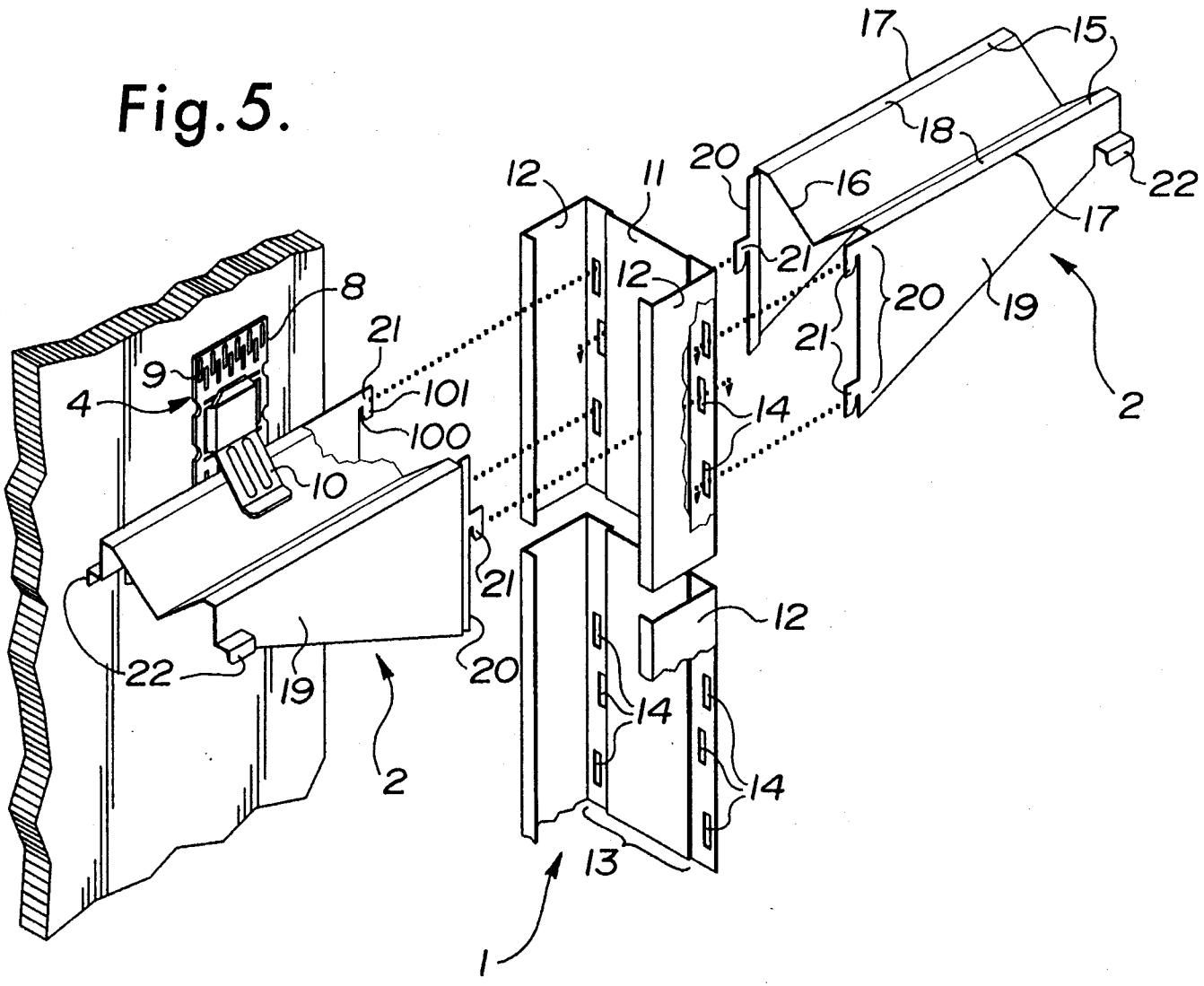

The suspension assemblies 4 suspending the gypsum board facing panels 3 are the subject of U.S. Pat. No. 3,948,011 and will only be described briefly herein. As shown in FIG. 5, each suspension assembly 4 comprises a gang nail plate 8 affixed by tangs 9 (embedded portion not shown) driven into the rear face of the facing panel 3. A removable hanger member in the form of a cam-type spring clip 10 is attached to the gang nail plate 8. The lower portion of the clip 10 is inclined rearwardly, away from the panel 3, to engage the bracket 2.

Returning to FIG. 4, individual brackets 2 are removably attached to the stud 1. Each bracket 2 projects laterally from one face or side of the stud 1. The bracket 2 is fully supported from the stud 1 without significant projection of the bracket through the other side of the stud. This arrangement permits installation of a stud 1 flush to the end of a wall E, such as at an abutting wall, corner or passageway. A plurality of brackets 2 are vertically spaced along each stud 1. Optionally, brackets 2 can be attached to both sides of the stud, horizontally aligned in pairs, extending from the stud 1 in opposing directions.

Figure 6:
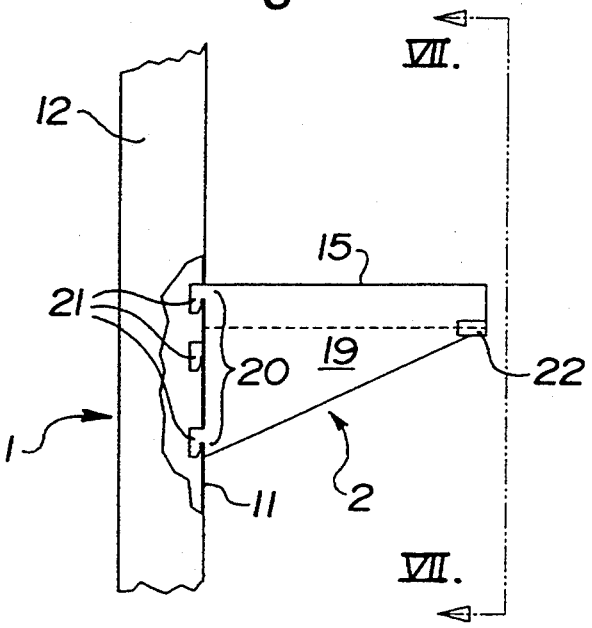
Figure 7:
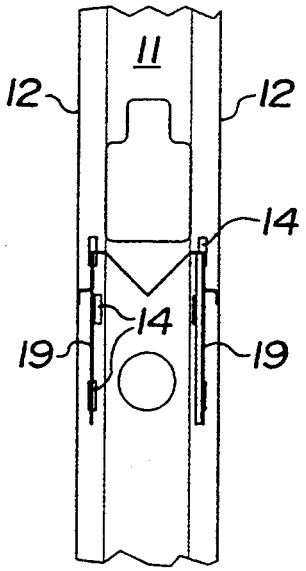

Having reference now to FIGS. 5–7, each stud 1 is C-shaped, having web 11 positioned transversely relative to the main plane of the wall A. The stud 1 has a facing pair of side walls or flanges 12. One or more vertically spaced patterns 13 of vertical slots 14 are formed in the stud's web 11, from which the brackets 2 are mounted.

Preferably the studs 1 are "C"-shaped, thin-gauge steel channels. Optionally, brackets 2 can be affixed to patterns of slots 13 formed in the webs 11 of a double-webbed stud, such as the stud disclosed in Menchetti '539.

Each bracket 2 comprises a horizontal channel wall 15, having a proximal edge 16 adjacent the stud's web 11, and two side edges 17 aligned parallel to the panels 3. Side shoulders 18 are formed on each of the side edges 17 for engaging the panel suspension assemblies 4. The width of the shoulder 18 cooperates with the suspension clip 10 to ensure that each panel is drawn into contact with the stud's flanges 12. The channel wall 15 extends laterally from the stud 1 a distance sufficient to engage a clip 10 of a suspension assembly 4, thereby suspending a panel 3.

The width of the channel wall 15 is designed to fit snugly between the flanges 12 of the C-stud 1, for reinforcing the stud and maintaining the spacing between the flanges when the stud is loaded.

Side walls 19 extend downwardly from the side edges of the channel wall 15, forming substantially vertical end edges 20 for engaging and abutting the stud's web 11. The lengths of the end edges 20 are sufficient to ensure that the suspended load of the panel 3 is distributed into the stud 1 without yielding, buckling or otherwise deforming either the side walls 19 or the web 11.

A plurality of slotted hooks 21 extend from the end edges 20 for engaging the pattern 13 of vertical slots 14 in the web 11. Each hook 21 is sized appropriately for penetrating a slot and engaging the web 11. Preferably each hook 21 forms a slot 100 having an angled outer surface 101 adapted to cause the bracket to be drawn in tightly against the web when engaged. The hooks 21 are spaced vertically along the end edge 20 in a pattern which is compatible with the pattern of vertical slots 13. Each hook 21 is sufficiently strong to resist deformation when loaded by the suspended panel 3.

Figure 10:
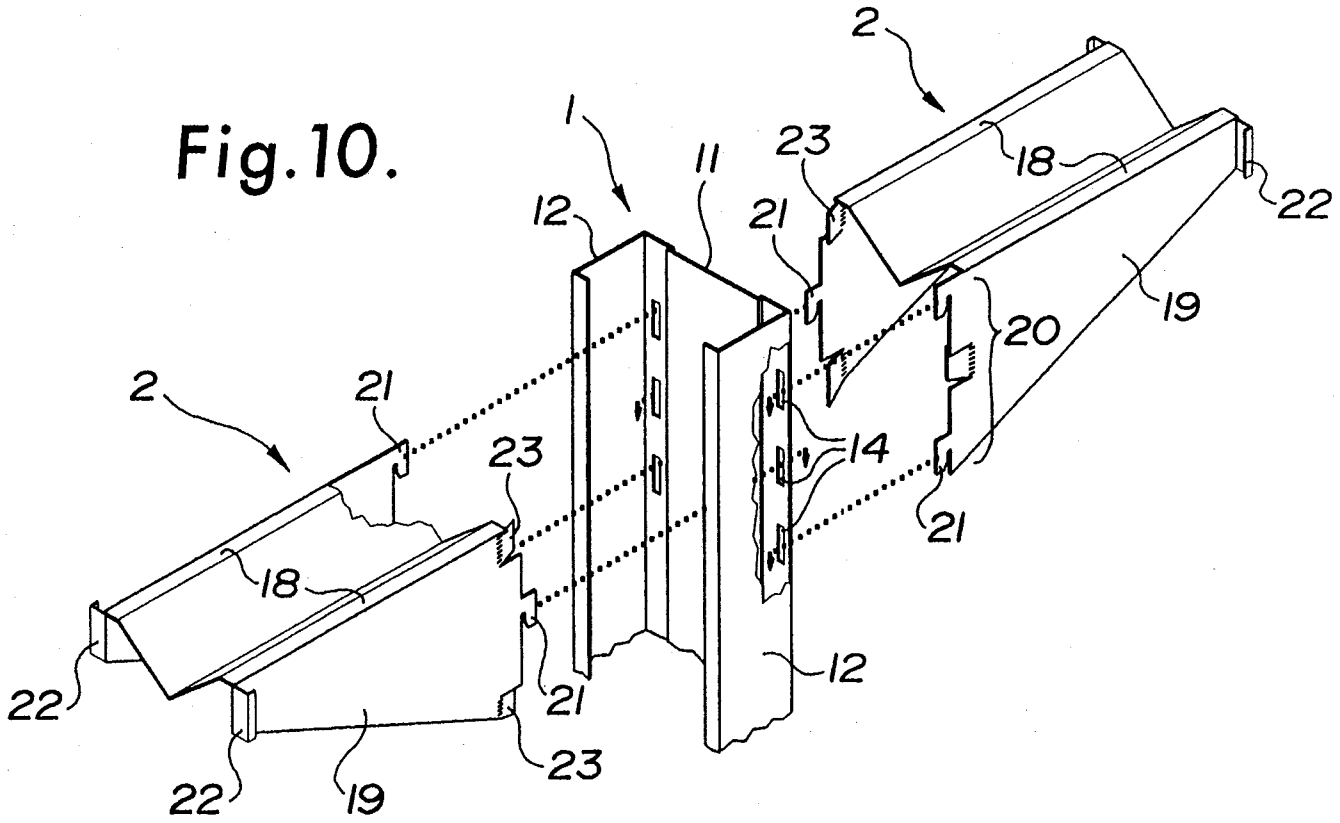

Panel spacing means 22 are provided at the distal end of the bracket 2, for spacing the bracket from the panel 3 so that the bracket's side shoulders 18 and the panel 3 are maintained in parallel alignment. The spacing means 22 protrude outwardly from each side wall 19 and can be a small "L"-shaped tab. Alternate forms of the spacing means 22 are seen in FIGS. 5 and 10.

In the particular embodiment shown in FIGS. 5–7, the bracket 2 is economically formed from a single sheet of material although other forms of construction would be suitable. Two side walls 19 are shown, providing two end edges 20. A total of three hooks 21 are located on the two end edges; two hooks 21 being located at the top and bottom of one end edge 20, a single hook being positioned intermediate the top and bottom of the other end edge. Preferably, the channel wall 15 is formed with a non-linear cross-section to improve its strength. As seen in FIGS. 5 and 7, the channel wall 15 is formed with sloped, inwardly converging support surfaces (V-shaped) for engaging and supporting the clips of suspension assemblies 4.

When two brackets 2, which have an identical pattern of hooks 21, are horizontally aligned on opposing sides of the stud 1, there is the potential for mechanical interference between opposing hooks 21. Generally, a bracket 2 constructed of light gauge sheet metal is sufficiently flexible to permit slight deflection of opposing hooks 21, enabling them to pass and occupy the same slot 14. It is preferable, however, that the spacing and numbers of hooks 21 on each vertical edge 20 of a bracket 2 be non-symmetrical. This enables the use of a unique slot 14 for each hook 21 of the opposing brackets 2, thereby avoiding mechanical interference.

Figure 8:
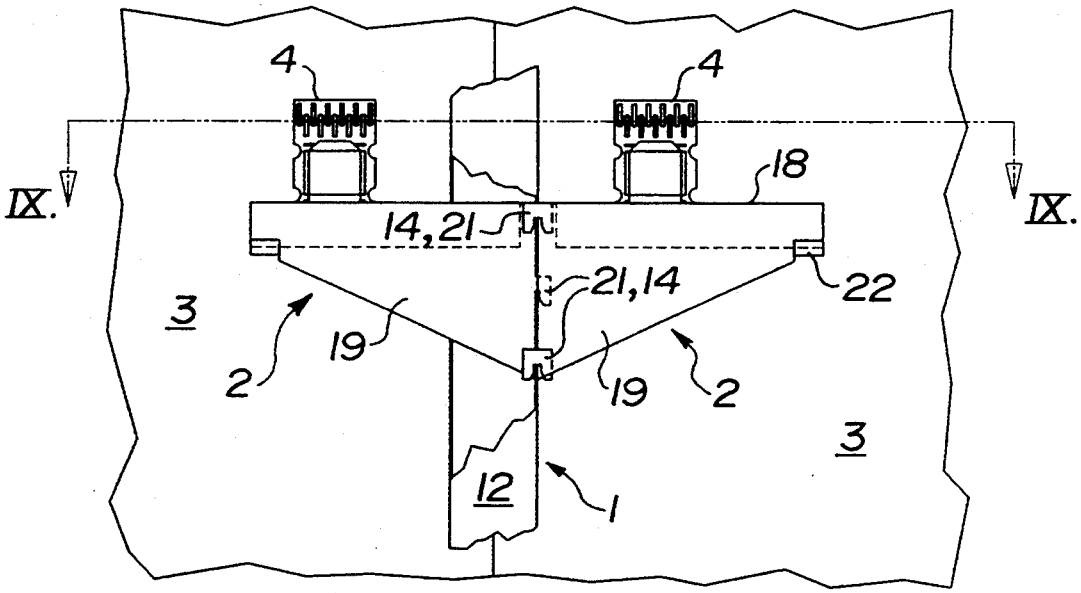
Figure 9:
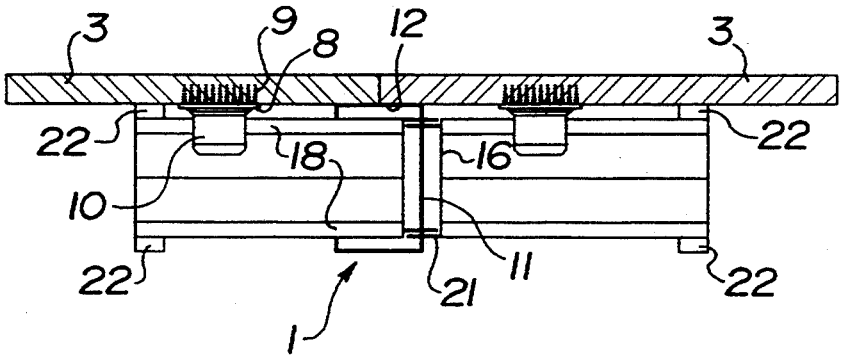

As previously stated, two hooks 21 are spaced apart widely on one end edge 20, and a single hook 21 extends from a location intermediate along the other end edge 20. As shown in FIGS. 8 and 9, this arrangement permits a six-slot pattern 13 to accommodate two opposing brackets 2, 2 without multiple use of any individual slot 14. In the embodiment shown in FIGS. 5–9, the end edge 20 of one triangular-shaped side wall 19 is locally offset slightly, though still parallel to the original plane of the side wall 19, thereby avoiding hook/hook 21/21 and hook/end edge 21/20 interference. Alternately, as shown in FIG. 10, tangs 23 can be created along the end edges 20, corresponding in position to an opposing bracket's hooks 21. The tangs 23 are bent inwardly to avoid interference with the hooks 21 and the stud's flanges 12.

As a result of the one-sided mounting and discontinuous nature of the bracket, the following advantages are realized:

the capability to use a standardized bracket for intermediate and end of wall applications;

the wall cavity, formed between panels, is substantially free, providing an unobstructed passageway for the installation of electrical, communications and other services; and the ability to utilize only a single type of stud (C-stud) for all situations, with the associated economic benefits.

What is claimed is:

1. A bracket adapted to be suspended from a vertical stud, comprising a web forming a pattern of vertical slots for engaging hooks by said bracket, said bracket adapted to engage a suspension assembly attached to the back of a facing panel to suspend said panel, said suspension assembly comprising a suspension clip having a portion extending angularly and rearwardly, said bracket comprising a channel wall which, when the bracket is in use, extends horizontally and has first and second ends, said channel wall being adapted to engage and support said suspension clips of facing panels; and a pair of side walls, each extending downwardly from one side edge of said channel wall, said side walls forming vertical end edges at said first end of said channel wall, said end edges having hook means extending therefrom for penetrating said stud web slots and engaging said web to suspend said bracket therefrom.

2. The bracket as set forth in claim 1 wherein:

each end edge has at least one hook extending therefrom, said hook forming a slot having an angled outer edge for drawing the bracket in firmly against the web as the bracket is loaded with a facing panel.

3. The bracket as set forth in claim 2 wherein:

one end edge has two vertically spaced apart hooks, one hook being located at the upper end of said end edge and the other hook at its lower end and the other end edge has only one hook located intermediate the ends of said end edge.

4. The bracket as set forth in claim 1 wherein:

said channel wall has inwardly sloped segments arranged in converging configuration.

5. The bracket as set forth in claim 1 wherein said side walls each have an outwardly protruding means at their second ends for spacing said facing panel from said bracket so that said facing panel and said side walls are substantially parallel.

6. A demountable wall partition assembly comprising:

ceiling and floor channels;

a pair of spaced apart, vertical, C-shaped metal studs extending between said channels to form a partition frame, each stud having a central web that is positioned transversely to the main plane of said frame and forming vertically spaced patterns of vertical slots, each pattern being generally aligned with an array of suspension assemblies;

a facing panel having front and back faces and a plurality of horizontal, vertically spaced, linear arrays of suspension assemblies attached thereto on said panel's back face, each suspension assembly having a suspension clip comprising a rearwardly and downwardly angled clip portion projecting therefrom;

a plurality of brackets suspended from said studs and engaging clip portions of said suspension assemblies so as to suspend said panel, each bracket comprising a generally horizontal channel wall having first and second ends, a pair of side walls, each extending downwardly from one side edge of said channel wall and forming vertical end edges at said first end of said channel wall, said end edges having hook means extending therefrom and into said vertical slots of said pattern so as to engage said web and suspend said bracket therefrom.

7. An assembly as set forth in claim 6 wherein:

a pair of brackets are suspended from adjacent studs in opposed, inwardly projecting relation at the same elevation and engage said clip portions of a linear array of suspension assemblies, said brackets each extending only part way between said studs.

8. An assembly as set forth in claim 7 wherein:

each bracket first end edge has at least one hook extending therefrom, said hook forming a slot having an angled outer edge for drawing said bracket in firmly against said web as said bracket is loaded with said facing panel.

9. An assembly as set forth in claim 8 wherein:

said side walls of each bracket each have outwardly protruding means adjacent their second ends for spacing said panel from said bracket so that said facing panel and said bracket are substantially parallel.

10. An assembly as set forth in claim 9 wherein:

one end edge of each bracket has two vertically spaced apart hooks, one hook being located at the upper end of said end edge and the other hook at its lower end and the other end edge has only one hook located intermediate the ends of said end edge.

11. An assembly as set forth in claim 6 wherein the channel wall has inwardly sloping segments arranged in converging configuration for engaging said clip portions.

* * * * *